US005555779A

United States Patent [19]

Holden

[11] Patent Number: 5,555,779

[45] Date of Patent: Sep. 17, 1996

[54] WHEELCHAIR PASSENGER DOOR OPENER

[76] Inventor: David J. Holden, 250 E. Alameda #331, Santa Fe, N.M. 87501

[21] Appl. No.: 509,817

[22] Filed: Aug. 1, 1995

[51] Int. Cl.[6] ..... B25B 33/00

[52] U.S. Cl. ..... 81/15.9; 81/488

[58] Field of Search ..... 81/15.9, 488; 294/19 R

[56] References Cited

U.S. PATENT DOCUMENTS

| | | | |
|---|---|---|---|
| 2,027,009 | 1/1936 | Wyscaver | 81/3 |
| 2,732,739 | 1/1956 | Liss | 81/3 |
| 2,750,222 | 6/1956 | Borah | 294/19 |
| 3,132,882 | 5/1964 | Farekas | 287/53 |
| 3,909,055 | 9/1975 | Koppel | 294/64 R |
| 4,307,908 | 12/1981 | Donaldson | 294/1 R |
| 4,433,863 | 2/1984 | Mathews | 294/19 R |
| 4,802,391 | 2/1989 | Willhoite et al. | 81/488 |
| 5,197,357 | 3/1993 | Cote | 81/15.9 |

*Primary Examiner*—James G. Smith

*Attorney, Agent, or Firm*—Jones, Tullar & Cooper, P.C.

[57] ABSTRACT

A universal tool enabling persons who are confined to a wheelchair to operate a variety of door-latches. The device also allows the individual to open the door more easily, once the latch has been operated, thereby improving mobility. The device includes a tubular shaft having a suction cup removably attached via a hinge to one end, a solid tubular hook-handle attached to the opposite end, and removable solid handles attached to the shaft near the suction cup end.

6 Claims, 1 Drawing Sheet

WHEELCHAIR PASSENGER DOOR OPENER

BACKGROUND OF THE INVENTION

For an individual confined to a wheelchair, there are many physical obstacles which tend to make it difficult to move from place to place. In recent years, much more attention has been given to making buildings, especially public buildings, more accessible to wheelchairs. For example, ramps have been installed to replace stairs, and many doors to public buildings are now available with automatic electric or mechanical openers.

On the other hand, unfortunately, there are still many buildings having doors which are not of the automatic variety. To pass through such a door, the wheelchair confined individual must first operate a door latch, and then open the door a sufficient amount allowing the wheelchair to pass through. To further complicate matters, there are many instances in which the physical relationships between the wheelchair, the door, and the surrounding walls or structures, often makes this operating and opening exercise quite difficult. Thus, not only is it often difficult to reach the door latch from a seated position in the wheelchair, but physical relationships make it difficult to open the door once the latch has been operated.

There are a variety of common door latches now in use, each of which must be manipulated in a particular manner to open the door. There have been prior art tools for opening doors, but these have been shown to be inadequate in that they are typically latch specific, i.e. they are not adaptable to allow their use in operating a variety of door latches. For example, many doors are opened by rotating a doorknob or a handle while others are opened by operating a pinch-type latch having an element which must be compressed. Thus, a variety of tools would have to be carried on the wheelchair to ensure that an appropriate tool is always available for each possible door latch.

Assuming that the wheelchair passenger can get close enough to use the appropriate tool required to operate the door latch, another hurdle needs to be overcome. This, often the biggest problem, is actually opening the door. The door must be pulled or pushed out of the way so that the individual can proceed in his/her wheelchair through the door opening. Again, at times this can be a frustrating, difficult or even impossible feat.

SUMMARY OF THE INVENTION

It is an object of the present invention to provide an aid for wheelchair-confined people, allowing them more mobility by providing a novel device which helps alleviate some of the problems associated with wheelchair travel.

It is an additional object of the present invention to provide a handy, easily manipulated device which not only allows a wheelchair confined individual to release a door latch more easily, but also enables the individual to open the door more easily.

An additional object of the present invention is to provide a device having a combination of features which provides a very handy tool, which will amplify the force applied by a person who is infirm, elderly, arthritic, etc., will allow operation of a variety of door latches, will permit opening of doors more easily regardless of their physical configuration. In this way the mobility of wheel-chair confined persons will be improved.

The present inventive door opener comprises a long tubular shaft having an operating device at each end, which devices are referred to herein as end effectors. This shaft has attached at one end a removable end effector comprising a suction cup to grip and operate round, cylindrical or oval door knobs. A hinge associated with this end effector enables the suction cup to engage knobs without requiring the user to be aligned directly with them. This allows latch operation from a seated position. In addition, at the opposite end of the tubular shaft is a permanently attached end effector. This hook-handle, affixed at right angles to the shaft, serves as a handle to provide leverage to operate the suction cup end effector. Also, the entire device can be reversed, with the hook-handle then serving as a hook to engage lever-type handles. Removable handles attached at right angles to the shaft provide operating leverage.

One of the removable handles, itself, serves as a third type of end effector. Mounted near the suction-cup end of the tubular shaft, at right angles to the shaft, the removable handle can be used in combination with the hook-handle to operate pinch-type latches. By proper placement of the hinge and suction cup, and proper manipulation of the removable handle, pinch-style latches can be operated.

Thus, during a first mode of operation, the hook-handle serves as a means to provide leverage to operate a doorknob engaged by the suction cup. In addition, the door opener can be reversed to be used in a second mode of operation, allowing the hook-handle to be used as a hook to engage lever-type latches. During this second mode of operation, the removable handles mounted at right angles to the shaft are used to provide rotational motion to the shaft. Finally, during a third mode of operation, pinch-style latches can be operated through manipulation of the hinge, suction cup and one of the removable handles.

BRIEF DESCRIPTION OF THE DRAWINGS

The foregoing and additional objects, features and advantages of the present invention will become apparent to those of skill in the art from the following detailed description of a preferred embodiment thereof, taken in conjunction with the accompanying drawings, in which.

DESCRIPTION OF PREFERRED EMBODIMENTS OF THE INVENTION

Figure 1:
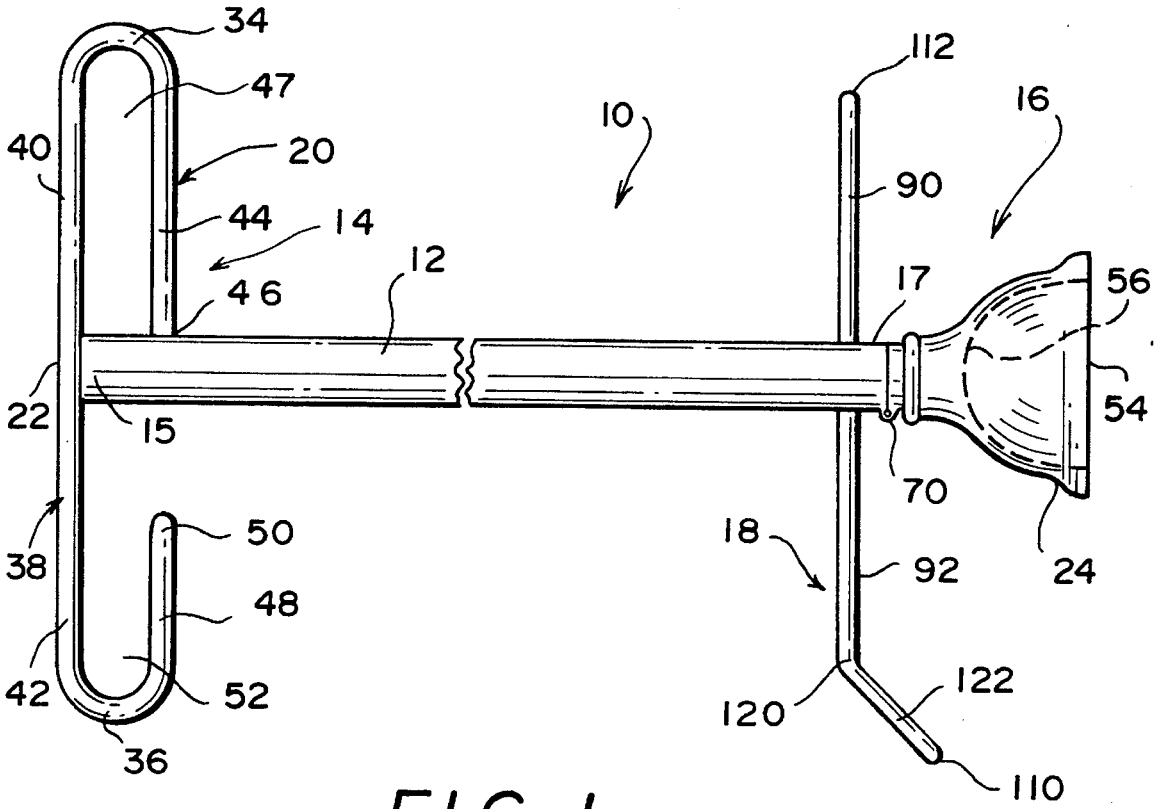
FIG. 1 is a side view of the wheelchair-passenger door opener.

The present inventive door opener depicted in FIG. 1 generally at 10 comprises a tubular shaft 12, a first end-effector 14 attached at one end 15 of the shaft, a second end effector 16 removably attached at the opposite end 17 of the shaft and a third end effector 18 attached to the shaft near one of its ends. In the illustrated embodiment, effector 18 is mounted at end 17 of the shaft.

Referring to FIG. 1, tubular shaft 12 is preferably formed from a lightweight but strong metal with walls thick enough to provide adequate strength to withstand both lengthwise (tension or compression) and sideways (bending or torsional) leverage. The shaft also may be formed from either solid metal or solid or hollow plastic, solid wood, fiberglass, or a variety of other materials providing sufficient rigidity to allow operation of conventional door latches. Although it is preferable to form the tubular shaft 10 approximately 40" in length, thus providing a length proper for use by an individual seated in a wheelchair, it is possible to form the device with any length appropriate for the physical size or other requirements of the individual user. The shaft is preferably formed with a 1-inch outside diameter, and is formed long enough to reach from a wheelchair-passenger's flexed arm to the door-knob of a door which is already open away from the passenger. The use of metal allows the rod to be light enough to be manipulated easily by an elderly individual.

The first end effector 14, consists of hook-handle 20 extending at a right angle to the axis of shaft 12. The tubular shaft is capped, allowing end 15 of the shaft to be fastened to the center 22 of the hook-handle by welding, for example. The interior wall of the opposite end 17 of the shaft is threaded, allowing the second end effector 16, consisting of a hinged suction cup 24, to be removably attached. Approximately ½ -inch from this end, two unthreaded holes 94 and 96 are formed diametrically opposite one another in the wall of the tubular shaft 12. These holes may be, for example, ⅜ inch in diameter to allow attachment of the third end effector 18, to be described later.

Hook-handle 20 is preferrably, formed from a solid, round, metal ⅜ inch diameter rod, but alternatively can be formed from solid metal, hollow metal, solid plastic, hollow plastic, solid wood, fiberglass, or any other material of sufficient rigidity. At each lateral end of the rod the hook-handle is shaped into opposed semi-circles 34 and 36 whose interior diameters are approximately 1.5 inches. The hook-handle 20 has a straight section of rod 38 having, for example, a length of 9 inches between the two semi-circles. The tubular shaft 12 is attached, at the approximate center of this 9-inch length to provide 4-inch hand grip sections 40 and 42. Section 40 of the rod is connected to one end of semicircle 34, with the other end being connected by way of section 44 to shaft 12. Section 44, is fastened (welded) firmly to the tubular shaft 12 at a location 46 spaced approximately 1.5 inches from the end 15 of the shaft to form a loop 47. Section 42 of the rod is connected to semicircle 36, with the other end of the semicircle being connected to a section 48 of the rod. This section 48 is left free with a 1.5-inch space between its free end 50 and the tubular shaft, forming a hook generally indicated at 52. The area defined between the curved and straight portions of the hook-handle 14 is formed only wide enough, approximately 1.5 inches, for a wheelchair passenger's fingers, while allowing for some play when hooked to a door-knob axle. The free end 50 of the rod is preferably capped by a semi-spherical dome.

Suction cup 24 is preferably formed from strong and resilient rubber or material having rubber-like flexibility. The suction cup should be as shallow as possible, e.g. preferably 1 inch or 1.5 inches deep from its edge 54 to its inside dome-center 56 (see FIG. 2) but large enough for adequate suction. On the other hand, the cup depth is chosen such that suction can be broken easily enough to allow removal. The cup sidewall 58 is resilient to allow the cup to fit snugly and tightly on an average door knob, which typically has a 1.5-inch outside diameter. In addition, the suction cup is formed with a rubber collar 60 defining a region into which a suction cup plug 62 is inserted and firmly held by, for example, strong glue or cement.

The suction cup plug 62 is preferably made of metal, although other materials may also be used. The plug is itself cup shaped having a hollowed-out portion 64 to minimize weight. The plug 62 fits tightly inside the suction cup collar 60 with a portion 66 of the plug projecting out from the suction-cup collar. A flared portion or wing 68 is formed at the top edge of the projected portion for attaching a hinge element 70. The hinge element 70 is preferably made of metal, although any material ensuring a hinge strong enough to withstand the torsion generated during the operation of door latches may be used.

Also connected to the hinge 70 is a cylindrical shaft plug 80. The hinge is located on both the suction cup plug and the shaft plug so that its hinge axis is at right angles to the axis of shaft 12 and to the removable handles which make up the effector 18, to be described later. The hinged connection between plugs 62 and 80 permits relative motion between the axially aligned relationship illustrated in FIG. 2 when the hinge is closed and an angled relationship when the hinge is open.

The shaft plug 80 is preferably made of metal, and is preferably formed with thin walls 82 defining an axially extending cup-shaped region 84 to minimize weight. The outside cylindrical surface of the plug 80 is formed with threads 86 which mate with interior threads 88 formed on an interior wall of the tubular shaft 12 so that plug 80 is securable within the end 17 of tuberlar shaft 12. Attachment in this manner allows the shaft plug 80, cup plug 62 and suction cup 24 to be removed from shaft 12 as a unit for replacing a worn suction cup. The shaft plug 80 is threaded far enough into the tubular shaft to serve as reinforcement for the handles of effector 18.

Figure 2:
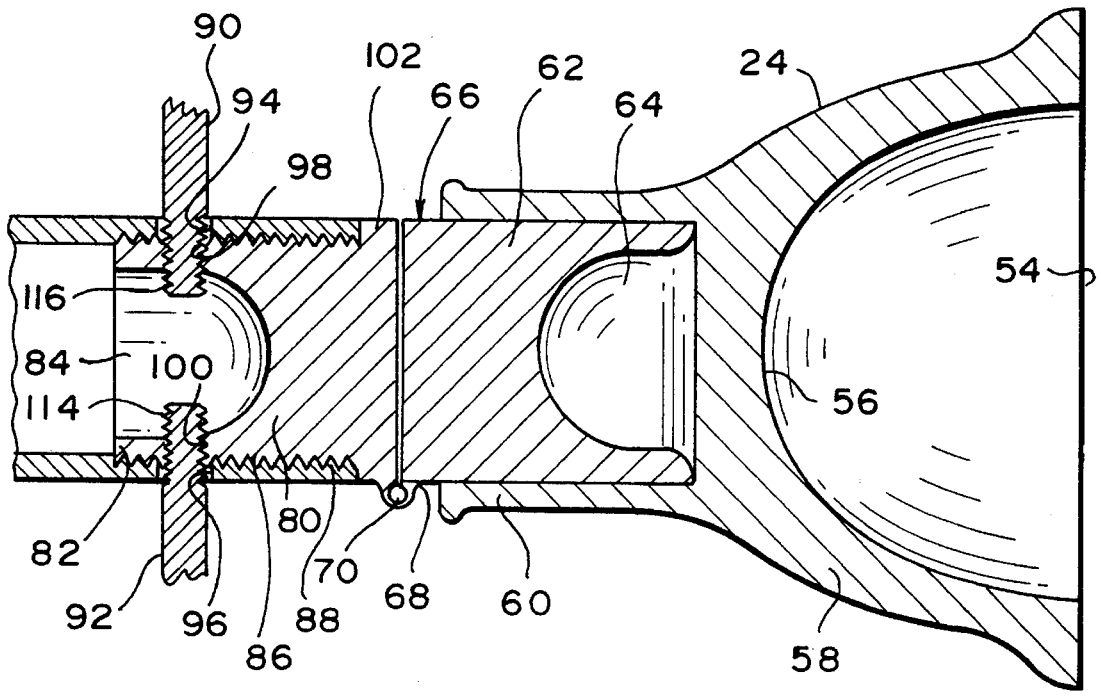
FIG. 2 is cross-section view of the removable end effector of the present invention.

Effector 18, as illustrated in FIG. 2, consists of a pair of laterally extending removable handles 90 and 92 which extend through diametrically opposed holes 94 and 96 in shaft 12 and through corresponding threaded holes 98 and 100 in wall 82. Holes 98 and 100 are drilled through the thin walls 82 of the plug 80, approximately ¾ inch from the hinged end 102 of the plug. The holes are threaded, and when aligned with holes 94 and 96 drilled in the tubular shaft 12, allow the removable handles 90 and 92 to be removably screwed into the plug. The holes are drilled so that each removable handle extends parallel to the hook-handle 14 and perpendicular to the axis of hinge 70.

Handles 90, 92 are preferably formed from solid, round ⅜ -inch diameter, light metal rod to reduce the weight of the door opener. One of the two handles (96) preferably is approximately 4.25 inches in length. The other (92) is 5.75 inches in length. Each is formed with a rounded dome at its outermost end, as at 110 and 112, and each is threaded at its inner end, as at 114 and 116, to engage the threaded holes 96 and 98, respectively, formed in the shaft plug 80, as described previously. The handles 90 and 92 are mounted on opposite sides of the tubular shaft 12, extending at right angles thereto and are easily removed if not needed.

In the preferred form of the invention, handle 90 is linear, while handle 92 is provided with a bend 120 at a point approximately 1.25 inches away from the threaded end 114 to form an angled portion 122. The handle is preferably bent in a rigid obtuse angle of about 60 degrees. The angled portion is calculated to open a door with a pinch type of latch, as will be described later. Handles formed in this manner provide a comfortable hand-grip and when needed serve as an effective means of rotating the tubular shaft 12.

Turning to the operation of the present invention, the three effectors described above make it possible for an individual to manipulate a variety of latches, including conventional doorknobs, lever-handle latches, and pinch-type latches.

First, with regard to opening and closing doors having conventional door knobs, a user first brings his wheelchair near to and facing the door. After locking the wheelchair wheels, and with the axis of hinge 70 positioned to point laterally toward the door hinges, the user presses the suction-cup 24 over the door knob, making it grip the door knob solidly. The hook-handle 20 is then twisted causing the suction cup 24 to rotate the door knob to unlatch the door.

To open a door which swings toward the wheelchair-passenger, the user unlocks the wheelchair wheels and pulls the door while backing the wheelchair. If necessary, the door knob can be hooked with the hook-handle end 14 after the door has been unlatched.

To open a door which swings away from the wheelchair-passenger, the user unlocks the wheelchair wheels, and moves the wheelchair forward, pushing the door open either with the wheelchair or with the wheelchair-passenger door opener.

To close a door which is opened toward the wheelchair-passenger, the user brings the wheelchair to face the nearest edge of the open door. By hand, or if necessary, with the hook handle 20, the user pushes the door to swing it closed. The wheelchair is moved as necessary to face the side of the door which will be visible to the user when the door is closed. The wheelchair wheels are locked, the suction-cup 24 is attached to the door-knob, and the door is pushed fully closed, while twisting the hook-handle 20 to latch the door.

To close a door which is opened away from the wheelchair-passenger, the user places the wheelchair close to the doorway latch, hooks the door knob with the hook handle 20 and pulls the door diagonally toward the doorway latch. If necessary, the user can back the wheelchair to allow the door to close. Also, if necessary, the user can latch the door by attaching the suction-cup to the door knob and twisting the hook-handle.

Next, with regard to using the present invention to open and close doors having lever handle type latches, the user first attaches the removable handles 90 and 92 to the tubular shaft 12 by screwing each handle into the holes formed slightly back from the suction cup collar. The user brings the wheelchair near to and facing the door. The wheelchair wheels are locked, the hook handle 20 is placed around the lever from above, and the removable handles 90, 92 are twisted to rotate the lever down to unlatch the door. The tubular shaft is then either pushed or pulled in a diagonal manner, depending on whether the door is to be opened or closed and the direction in which the door opens.

Turning to the opening and closing of doors having pinch type latches, the user first attaches to the tubulor shaft 12 the removable handle 92 with its angled portion 122 this is accomplished by screwing it into the hole formed slightly back from the suction cup collar on the hinge side of the tubular shaft.

To open and close doors having pinch type handles, the user brings the wheelchair near to and facing the door, locks the wheelchair wheels and manipulates the present invention until the axis of hinge 70 is facing the floor. The suction cup is pressed against the door above the latch to position the free end of the removable handle 92 over the pinch latch. With the suction cup attached to the door, the tubular shaft 12 rotates about the hing axis as it is lowered in the direction of the floor. This brings the angled end 122 of the removable handle 92 in contact with the pinch latch. The user presses the removable handle against the pinch latch until the latch disengages, allowing the door to be opened. The tubular shaft is pushed or pulled in a diagonal motion depending on whether the door is to open or close.

When not in use, the wheelchair-passenger door opener can be carried by hooking it over the wheelchair chair-back and laying it diagonally down between the chair-arms beside the wheelchair-passenger. The two removable handles can be carried in a small bag looped to a wheelchair arm.

Although the present invention has been described in terms of preferred embodiments thereof, it will be apparent to those of skill in the art that numerous variations and modification may be made without departing from the true spirit and scope thereof as set forth in the following claims.

What is claimed is:

1. A door opener for opening a door having a door latch comprising:

a shaft having first and second ends;

a first end effector, permanently attached to said first end of said shaft for removably attaching the door opener to a lever type door latch;

a second end effector, removably attachable to said second end of said shaft for removably attaching the door opener to a doorknob type door latch;

a first handle for rotating said shaft to rotate said second end effector to operate the doorknob type latch;

a second handle removably attachable to said shaft for rotating to said shaft rotate said first end effector to operate the lever type door latch;

a hinge for pivoting said shaft with respect to said second effector; and, a third end effector removably attachable to said shaft near said second end for operating a pinch type door latch as said third end effector is brought into operating engagement with the latch and said shaft is pivoted with respect to said second end effector.

2. The door opener of claim 1 wherein said first end effector includes a hook portion for engaging a lever type door latch.

3. The door opener of claim 1 wherein said second end effector includes a suction cup for engaging a doorknob type door latch, and means for removably attaching said second end effector to said shaft.

4. A door opener for opening a door having a door latch comprising:

a shaft having first and second ends;

first and second handles removably attached to said shaft near said second end for rotating said shaft;

a hook-handle element attached to said first end, said element forming a third handle portion for rotating said shaft, and a hook portion for removably attaching the door opener to a lever type door latch to operate the latch when said shaft is rotated by said first and second handles; and, a suction cup element removably attached to said second end for removably attaching the door opener to a doorknob type door latch to operate the latch as said shaft is rotated by said third handle portion.

5. The door opener of claim 4 wherein said suction cup element includes a hinge allowing pivoting of said first handle into operating engagement with a pinch type door latch when the door opener is removably attached to the door via said suction cup element.

6. The opener of claim 5 wherein said suction cup element includes a suction cup, a first plug connected to said suction cup, a second plug connected to said second end of said shaft, and said hinge pivotally coupling said first and second plugs.

* * * * *

UNITED STATES PATENT AND TRADEMARK OFFICE

CERTIFICATE OF CORRECTION

PATENT NO. : 5,555,779
DATED : September 17, 1996
INVENTOR(S) David J. HOLDEN

It is certified that error appears in the above-indentified patent and that said Letters Patent is hereby corrected as shown below:

Column 6, line 23:
Claim 1, line 13, change "to said shaft" to read --said shaft to--.

Signed and Sealed this

Eleventh Day of February, 1997

Bruce Lehman

*Attest:*

BRUCE LEHMAN

*Attesting Officer*

*Commissioner of Patents and Trademarks*